United States Patent [19]

Lopez et al.

[11] Patent Number: 4,710,486

[45] Date of Patent: Dec. 1, 1987

[54] PROCESS FOR PREPARING HEAVY OIL HYDROPROCESSING SLURRY CATALYST

[75] Inventors: Jaime Lopez, Benicia, Calif.; Eugene A. Pasek, Export, Pa.

[73] Assignee: Chevron Research Company, San Francisco, Calif.

[21] Appl. No.: 767,768

[22] Filed: Aug. 21, 1985

Related U.S. Application Data

[63] Continuation-in-part of Ser. No. 527,414, Aug. 29, 1983, Pat. No. 4,552,821.

[51] Int. Cl.[4] ..... B01J 27/047; B01J 27/051

[52] U.S. Cl. ..... 502/219; 502/220; 208/108; 208/215

[58] Field of Search ..... 502/219, 220, 221

[56] References Cited

U.S. PATENT DOCUMENTS

| | | | |
|---|---|---|---|
| 3,915,894 | 10/1975 | Clements et al. | 502/220 |
| 4,226,742 | 10/1980 | Bearden, Jr. et al. | 502/220 X |
| 4,243,553 | 1/1981 | Naumann et al. | 502/220 |
| 4,431,747 | 2/1984 | Seiver et al. | 502/220 |

*Primary Examiner*—Olik Chaudhuri

*Attorney, Agent, or Firm*—S. R. LaPaglia; T. G. DeJonghe; O. T. Dickinson

[57] ABSTRACT

A process for the preparation of a dispersed Group VIB metal sulfide hydrocarbon oil hydroprocessing catalyst comprising reacting aqueous ammonia and a Group VIB metal compound, such as molybdenum oxide or tungsten oxide, to form a water soluble oxygen-containing compound such as aqueous ammonium molybdate or tungstate. The aqueous ammonium molybdate or tungstate is sulfided in at least three sulfiding steps of increasing temperature including a low temperature sulfiding step, an intermediate temperature sulfiding step and a high temperature sulfiding step. Some of the oxygen associated with said Group VIB metal is replaced by sulfur in each of the sulfiding steps. It has been found the maximum total level of replacement of oxygen by sulfur achieved in the intermediate temperature step is particularly critical to catalyst activity. In accordance with this invention, in the intermediate temperature sulfiding step the maximum total stoichiometric level of replacement by sulfur of oxygen associated with the Group VIB metal reaches a level of 50 to 95 percent. Additional replacement of oxygen with sulfur occurs in the high temperature sulfiding step.

36 Claims, 4 Drawing Figures

PROCESS FOR PREPARING HEAVY OIL HYDROPROCESSING SLURRY CATALYST

This application is a continuation-in-part of Ser. No. 527,414, filed Aug. 29, 1983, by J. Lopez, J. D. McKinney and E. A. Pasek which issued as U.S. Pat. No. 4,552,821, on Dec. 10, 1985.

This invention relates to a process for preparing a slurry catalyst for the hydroprocessing of heavy hydrocarbon oils including crude oils, heavy crude oils and residual oils as well as refractory heavy distillates such as FCC decanted oils and lubricating oils. The slurry catalyst can also be used for the hydroprocessing of shale oils, oils from tar sands, and coal liquids.

The catalyst prepared by the present invention is an unsupported circulating sulfided Group VI metal slurry catalyst, specifically a molybdenum sulfide or tungsten sulfide catalyst. The circulating nature of the slurry catalyst of this invention is conducive to the employment of elevated process temperatures. In contrast, elevated temperatures would be impractical in a fixed bed system. The employment of high process temperatures in conjunction with a fixed bed catalyst induces progressive coke accumulation on the catalyst leading to a catalyst aging problem. In contrast, with a slurry catalyst, catalyst rejuvenation can be very rapid since fresh catalyst can be continuously introduced to the system while used catalyst can be continuously regenerated or removed from the system so that there is no catalyst aging problem.

The particles of the slurry catalyst of this invention exist as a substantially homogeneous dispersion in an oil or water/oil mixture of very small particles made up of extremely small crystallites. The activity of the catalyst is in significant part dependent upon the smallness of particle size. The catalyst is essentially Group VIB metal disulfide which is probably structured molecularly as basal platelets of Group VIB metal atoms separated by two layers of sulfur atoms with activity sites concentrated at the edge of each basal plane of the Group VIB metal atoms.

The catalyst of the present invention comprises dispersed particles of a highly active form of a Group VIB metal sulfide, including very active molybdenum sulfide and tungsten sulfide. The first step in catalyst preparation comprises formation of an oxygen containing soluble ammonium salt of molybdenum or tungsten for sulfiding. Ammonium molybdates or ammonium tungstates are suitable soluble salts. The ammonium molybdates or ammonium tungstates are then sulfided with a sulfiding agent in a plurality of zones of increasing temperature, including low, intermediate and high temperature sulfiding zones. The low and intermediate temperature sulfiding zones contain water and can be operated either in the presence of feed oil or in the substantial absence of feed oil. Feed oil and water are present in the high temperature sulfiding zone. If feed oil is not present in the low and intermediate temperature sulfiding zones, ammonia can be separated from the system after the last sulfiding zone before addition of feed oil.

Molybdenum sulfide is the preferred Group VIB metal sulfide. The final catalyst can comprise crystallites of $MoS_2$, although the atomic ratio of sulfur to molybdenum is frequently not 2 or is only approximately 2. If the catalyst is $MoS_2$, it is an exceptionally active form of $MoS_2$ and is more active catalytically than $MoS_2$ of the prior art. It appears that the activity of the final catalyst depends upon the conditions employed during its preparation. Application U.S. Pat. No. 4,552,821, filed Aug. 29, 1983, which is hereby incorporated by reference, taught the presence of feed oil during multistage sulfiding of the precursor ammonium salt to $MoS_2$ and did not teach ammonia removal during catalyst preparation. An improvement in catalyst activity can be achieved by performing a significant portion of the multistage sulfiding of the precursor ammonium salt to $MoS_2$ in an aqueous phase in the substantial absence of any hydrocarbon oil phase and by separating ammonia from the system in advance of adding an oil phase. In either mode of operation, we have now discovered that an improvement in activity of the final catalyst is achieved by specifically regulating the amount of sulfiding occurring in the intermediate temperature sulfiding stage.

We have now discovered that although some of the oxygen associated with the Group VIB metal in the soluble ammonium precursor compound is replaced by sulfur in each of the low, intermediate and high temperature sulfiding stages, the total level of replacement of oxygen with sulfur which is achieved in the intermediate temperature stage is unexpectedly critical to the activity of the final catalyst. We have found that catalyst activity is improved when the total stoichiometric replacement of oxygen associated with Group VIB metal with sulfur reaches a maximum of 50 to 95 percent, generally, 70 to 85 percent, preferably, and 75 to 80 percent, most preferably, in the intermediate temperature sulfiding stage, provided that some of the indicated replacement of oxygen with sulfur occurs in the low temperature stage and additional replacement of oxygen with sulfur occurs occurs in the high temperature stage.

The molybdenum sulfide catalyst of the present invention can be prepared by dissolving a molybdenum compound, such as $MoO_3$, in aqueous ammonia to form ammonium molybdates, with or without the subsequent injection of hydrogen sulfide to the dissolving stage. The ammonium molybdates are generally soluble in the aqueous medium but the addition of hydrogen sulfide causes some dissolved molybdenum to separate as ammonium molybdenum oxysulfide solids.

According to U.S. Pat. No. 4,552,821, aqueous ammonium molybdenum oxysulfide from the dissolving stage is mixed with all or a portion of the feed oil stream using the dispersal power of a hydrogen-hydrogen sulfide stream and the admixture is passed through a plurality of sulfiding zones of ascending temperature. The sulfiding zones can be three in number, to provide a time-temperature sequence which is necessary to complete the preparation of the slurry catalyst prior to passing it to the higher temperature exothermic hydroprocessing reactor zone. Each sulfiding zone is operated at a temperature higher than its predecessor. The residence time in each sulfiding zone is sufficient to inhibit excessive coking.

According to the present invention, the sulfiding of the catalyst is performed in at least three stages. The first sulfiding stage is operated at a relatively low temperature with an aqueous phase and with or without feed oil. The second sulfiding stage is operated at an intermediate temperature which is higher than the temperature of the low temperature sulfiding stage with an aqueous phase and either with or without feed oil. In accordance with the present invention, the total level of sulfiding achieved in the intermediate temperature stage (which total includes sulfiding performed in any prior stage) is critical. The third sulfiding stage is a high temperature stage and is operated with both water and feed oil at a temperature which is higher than the temperature in the intermediate temperature sulfiding stage.

A water soluble oxygen-containing precursor ammonium salt of molybdenum or tungsten such as ammonium molybdate or ammonium tungstate is supplied to the low temperature sulfiding stage. The sulfiding reactions occurring in the low and intermediate sulfiding stages generate ammonia from gradual decomposition of ammonium molybdate or ammonium tungstate. If no oil is present, this ammonia, together with any excess ammonia present from the earlier reaction of ammonia with molybdenum oxide or tungsten oxide, can be flashed in a separator zone and separated from slurry-containing separator residue in advance of the first stage to which feed oil is added. Feed oil is added to the separator residue and the separator residue with feed oil is passed to the next sulfiding stage.

The ammonia removal step has a favorable effect upon catalyst activity because ammonia may be a depressant to the activity of a hydrogenation catalyst. Ammonia is easily separable from the substantially oil-free aqueous phase effluent from the low or intermediate temperature sulfiding stages by cooling and depressurizing the slurry stream. In contrast, the presence of an oil phase (as in the low and intermediate temperature sulfiding stages of the process of U.S. Pat. No. 4,552,821 would make ammonia removal considerably more difficult because ammonia is considerably more difficult to separate from an oil/water system than from a water phase free of oil.

The ammonium molybdate or ammonium tungstate is sulfided with hydrogen sulfide, with or without hydrogen, in a relatively low temperature reactor to replace some of the oxygen associated with the Group VIB metal with sulfur. The sulfiding reaction is continued in an intermediate temperature reactor, to replace an additional amount of oxygen associated with the Group VIB metal with sulfur. In the intermediate temperature reactor the total amount of oxygen which was present in the ammonium molybdate or ammonium tungstate which is replaced with sulfur reaches a level most preferably of 75 to 80 percent on a stoichiometric basis.

The effluent stream from the intermediate temperature sulfiding reactor either contains feed oil or is mixed with feed oil for the first time and is passed together with hydrogen sulfide and hydrogen to a high temperature sulfiding reactor. Additional oxygen associated with the Group VIB metal is replaced by sulfur in the high temperature sulfiding reactor. A water-oil slurry comprising dispersed generally molybdenum disulfide or tungsten disulfide particles is produced in the high temperature sulfiding reactor.

If the temperature in the high temperature sulfiding reactor is sufficiently high for hydroprocessing the feed oil, the residence time in the high temperature reactor can be sufficient to accomplish both the high temperature sulfiding and the required hydroprocessing reactions. If a higher temperature is required to accomplish hydroprocessing of the feed oil, the effluent stream from the high temperature reactor is passed to a hydroprocessing reactor operated at a hydroprocessing temperature which is higher than the temperature in the high temperature sulfiding reactor.

Although not to be bound by any theory, it is believed that the following reactions occur in the various catalyst preparation steps. In the first catalyst preparation step, in the molybdenum embodiment of this invention, insoluble, crystalline $MoO_3$ is mixed with water to form a non-oleaginous slurry which is reacted with ammonia to form soluble ammonium molybdates. As an example consider the following generalized equation for the formation of ammonium heptamolybdate:

$$\underset{\text{Insoluble Crystalline}}{7MoO_3} + 6NH_3 + 3H_2O \longrightarrow \underset{\text{Soluble}}{(NH_4)_6Mo_7O_{24}}$$

The $MoO_3$ is dissolved under the following conditions:

| | | |
|---|---|---|
| $NH_3$/Mo Weight Ratio | 0.1 to 0.6; | preferably 0.15 to 0.3 |
| Temperature, °F. | 33 to 350; | preferably 120 to 180 |
| Pressure: psig | 0 to 400; | preferably 0 to 10 |

The pressure and temperature are not critical. Increased pressure is required to maintain the ammonia in aqueous solution at elevated temperatures. An elevated temperature is necessary to insure reaction and vary the concentration of molybdenum dissolved in the solution.

The ammonium molybdate solution is passed to a series of sulfiding reactors operated at ascending temperatures. It is first passed to a relatively low temperature sulfiding reactors where it is contacted with gaseous hydrogen sulfide, preferably a hydrogen/hydrogen sulfide blend, with or without feed oil. The generalized sulfiding reaction is as follows:

$$(NH_4)_6Mo_7O_{24} + H_2S \longrightarrow \underset{\text{amorphous}}{(NH_4)_xMoO_yS_z}$$

The above is a generalized equation for when ammonium heptamolybdate is the starting material. The reaction products in the low temperature sulfiding reactor include ammonium molybdates, ammonium molybdenum oxysulfides and possibly molybdenum sulfides.

Following are the conditions in the low temperature sulfiding reactor:

| | | |
|---|---|---|
| SCF $H_2S$/lbs Mo Ratio | above 2.7; | preferably above 12 |
| Temperature, °F. | 70 to 350; | preferably 130 to 180 |
| Hydrogen sulfide partial pressure, psi | 3 to 400; | preferably 150 to 250 |

It is important not to exceed the above temperature range in the low temperature reactor. At temperatures above 350° F. ammonia loss from the catalyst precursor will occur faster than thiosubstitution can proceed and the resultant molybdenum compound will precipitate and possibly plug the reactor. It is possible to operate the low temperature reactor at a temperature below 325° or 350° F. for a relatively long duration to allow the thiosubstitution reaction to proceed faster than ammonia loss so that the molybdenum compound will not precipitate.

The effluent stream from the low temperature reactor is passed to an intermediate temperature reactor, which may or may not contain oil, operated under the following conditions:

| | | |
|---|---|---|
| Temperature, °F. | 180 to 700; | preferably 300 to 550 |
| Hydrogen sulfide Partial pressure, psi | 3 to 440; | preferably 150 to 250 |

The temperature in the intermediate temperature reactor is higher than temperature in the low temperature reactor. The time required will be sufficient to accomplish the level of sulfiding of the molybdenum compound required in that stage by the present invention.

The following generalized reaction may occur in the intermediate temperature reactor:

$$(NH_4)_xMoO_yS_z + H_2S \rightarrow MoO_{x'}S_{y'} + NH_3$$

where x' is about 1 y' is about 2

The molybdenum compound in the intermediate temperature reactor is sufficiently sulfided so that upon loss of ammonia it is in a particulate form which is sufficiently fine that it can remain dispersed with sufficient agitation. In addition, the molybdenum compound is sufficiently sulfided that a crystalline structure is evolving from the amorphous form it exhibited in the low temperature sulfiding temperature.

The reactions in the low and intermediate temperature reactors generate ammonia. If no oil is present, the ammonia can be flashed from the system after either of these reactors. Flash conditions are controlled so as to maximize removal of ammonia while retarding water vaporization and loss. Adequate water retention is required to sustain the catalyst as a slurry which is sufficiently fluid to permit pumping and to accomplish dispersion of the catalyst in the feed oil which is added later.

In the effluent from the intermediate temperature reactor, the sulfur level in the precursor catalyst represents a conversion to sulfur preferably of between 70 and 85 percent on a stoiciometric basis of the oxygen originally associated with the soluble ammonium molybdate. This conversion represents the total replacement of oxygen with sulfur in the ammonium molybdate compound occurring in the entire system through the intermediate temperature stage. The molybdenum compound leaving the intermediate temperature sulfiding stage requires further conversion of oxygen to sulfur to achieve the molybdenum sulfide active catalyst state. This further conversion occurs in the presence of oil in a high temperature sulfiding reactor, which is operated a temperature above the temperature of the intermediate temperature sulfiding reactor. The reaction occurring in the high temperature sulfiding reactor in the presence of an oil/water phase may be expressed by the following equation:

$$MoO_xS_y \xrightarrow{H_2/H_2S} \underset{\text{Highly Active}}{MoS_2} + H_2O$$

where x is about 1 y is about 2

The high temperature sulfiding reactor is operated at a temperature in the range 500° to 750° F. and can also be employed as the hydroprocessing reactor if the feed oil is capable of being hydroprocessed at the temperature of the high temperature sulfiding reactor. However, feed oils commonly require hydroprocessing at temperatures above the temperature of the high temperature sulfiding reactor. In such case, a downstream hydroprocessing reactor is required. In general, the temperature in the hydroprocessing reactor is 650° to 950° F. and is above the temperature of the high temperature sulfiding reactor.

The residence time in each sulfiding zone can be, for example, 0.05 to 0.5 hours or more. The various sulfiding zones can employ the same or different residence times. For example, a residence time of at least 2 hours may be useful in the high temperature sulfiding reactor. In general, the residence time in each sulfiding zone can be at least 0.02, 0.05, 0.1 or 0.2 hours. The residence time in each zone can be at least 0.3, 0.4 or 0.5 hours. Each sulfiding zone is constituted by a time-temperature relationship and any single reactor can constitute one or more sulfiding zones depending upon whether the stream is heated or is at a constant temperature in the reactor during stream residency in the reactor.

The total pressure in the sulfiding zones and the hydroprocessing reactor can be between 500 and 5,000 psi.

If the aqueous catalyst precursor leaving the intermediate temperature reactor were to be passed together with feed oil and hydrogen/hydrogen sulfide directly to a hydroprocessing reactor operated at a temperature above the temperature of the high temperature sulfiding reactor, such as 800° F., or above, the molybdenum compound would react with the water present to lose sulfur rather than gain it to form an inactive catalyst according to the following reaction:

$$MoO_xS_y + H_2O \xrightarrow{800°\ F.} \underset{\text{Inactive Catalyst}}{MoO_{x'}S_{y'}} + H_2S \text{ or } (MoO_2/MoS_2 + H_2S)$$

where y' is less than 2. This material is not a sufficiently active catalyst to inhibit coking reactions. It is noted that the $MoO_xS_y$ (where x is about 1, y is about 2) in the presence of hydrogen sulfide and water reacts preferentially with the hydrogen sulfide to become sulfided at a temperature between 500° to 750° F. It has been found that the $MoS_2$ catalyst formed in the temperature range 500° to 750° F. is a low coking catalyst. However, at a temperature above this range, the $MoO_xS_y$ (where x is about 1 and y is about 2) in the presence of hydrogen sulfide and water reacts to form $MoO_{x'}S_{y'}$ (where y' is less than 2), which is inactive.

The catalyst preparation method described above uses $MoO_3$ as a starting material for preparing the catalyst precursor. However, other molybdenum compounds are also useful. For example, thiosubstituted ammonium molybdates, such as ammonium oxythiomolybdate or ammonium thiomolybdate can be employed. Since these materials are produced from $MoO_3$ in the first two catalyst preparation steps described above, i.e. the reaction of $MoO_3$ with ammonia step and the low temperature sulfiding step, these two steps can be by-passed by employing these thiosubstituted compounds as starting materials. Therefore, when these thiosubstituted compounds are used as catalyst precursors a water slurry thereof can be injected with hydrogen sulfide and hydrogen and passed directly to the intermediate temperature sulfiding reactor described above, with the extent of conversion of oxygen to sulfur described above, followed by separation of ammonia and then the high temperature sulfiding reactor and the hydroprocessing reactor, as described above.

It will be appreciated that the low, intermediate and high temperature sulfiding zones, stages or steps described herein can consitute separate reactors, as illustrated, or some or all of these zones, stages or steps can be merged into a single reactor. In terms of concept, each of these sulfiding zones, stages or steps is represented by a residence time-temperature relationship. If the stream is heated through the temperature range indicated above for any sulfiding zone, stage or step for the time indicated above, then the performance of the process requirements to satisfy that zone, stage or step has occurred.

The embodiment of the present invention which relates to a method for the preparation of a dispersed tungsten sulfide hydrocarbon oil hydroprocessing catalyst is essentially analogous to the molybdenum sulfide catalyst preparation method described above. In the first stage, a tungsten salt, such as $WO_3$, is slurried in water and reacted with ammonia to form water soluble ammonium tungstate. The ammonium tungstate is then sulfided in the same sequence in ascending temperature sulfiding reactors with a similar ammonia separation step, as described for the molybdenum catalyst preparation sequence.

$$WO_3 + NH_3 + H_2O \longrightarrow \text{Soluble Ammonium Tungstate}$$

Insoluble

The following reaction occurs in the low temperature sulfiding reactor:

$$\text{Soluble Ammonium Tungstate} + H_2S \rightarrow (NH_4)_xWO_yS_z$$

The reaction occuring in the intermediate temperature sulfiding reactor is:

$$(NH_4)_xWO_yS_z + H_2S \rightarrow WO_{x'}S_{y'} + NH_3$$

where x' is about 1 y' is about 2

In the low and intermediate temperature reactors preferably a total of 70 to 85 percent stoichiometrically of the oxygen in the original soluble ammonium tungstate compound is converted to sulfur.

Finally, the reaction occuring in the high temperature sulfiding reactor is:

$$WO_xS_y \rightarrow WS_2 + H_2O$$

where x is about 1 y is about 2

If desired, the method of the present invention can be employed to produce a combination $MoS_2$—$WS_2$ catalyst. Also, a Group VIII metal such as nickel can be incorporated into the catalyst prepared according to the present invention.

DETAILED DESCRIPTION OF THE FIGURES

Figure 1:
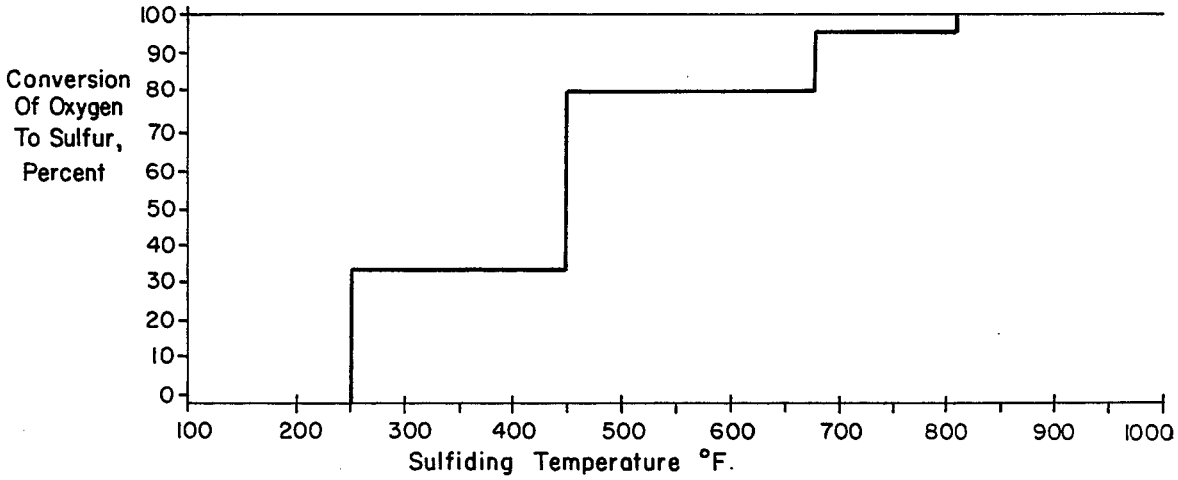
FIG. 1 illustrates the stoichiometric level of conversion of oxygen to sulfur in a molybdenum catalyst precursor achieved in the various sulfiding stages.

FIG. 1 presents a graph of percentage conversion on a stoichiometric basis of oxygen to sulfur in an oxygen containing molybdenum catalyst precursor achieved during the various sulfiding stages. The percentage conversion of oxygen to sulfur can be expressed by the following equation:

$$\text{Percent conversion} = \frac{(O/Mo)_I - (O/Mo)}{(O/Mo)_I} \times 100$$

where (O/Mo)—represents the atomic ratio of oxygen to molybdenum in the molybdenum compound at a given point in the catalyst preparation process, and $(O/Mo)_I$—denotes the initial atomic ratio of oxygen to molybdenum, i.e. the ratio in the molybdenum compound before sulfiding begins.

FIG. 1 illustrates a preferred sulfiding sequence for an ammonium molybdate precursor in an oil/water sulfiding system using a 190 psi partial pressure of hydrogen sulfide. The sulfiding represented in FIG. 1 occurred in three stages of progressively increasing temperature, including a low temperature stage, an intermediate temperature stage and a high temperature stage. The duration of each sulfiding stage was 20 to 25 minutes. As shown in FIG. 1, the low temperature sulfiding stage was operated at a temperature of 250° F., the intermediate temperature sulfiding stage was operated at a temperature of 450° F., the high temperature sulfiding stage was operated at a temperature of 680° F. and the finished catalyst was passed to a hydroprocessing reactor operated at about 810° F.

It is important for the low temperature sulfiding stage to be operated at a temperature below 350° F. so that the rate of thiosubstitution is faster than the rate of ammonia loss. At a low temperature sulfiding stage temperature above 350° F., the rate of ammonia loss is greater than the rate of thiosubstitution, producing molybdenum compounds which precipitate out and are more difficult to thiosubstitute. At a temperature below about 325° F. or 350° F., the rate of thiosubstitution is significantly faster than the rate of ammonia loss and a suspended slurry of sulfided catalyst particles is formed.

FIG. 1, shows that when the low temperature sulfiding stage was operated at a temperature of 250° F. a 33 percent conversion of the oxygen in the molybdenum precursor compound to sulfur was achieved. FIG. 1 further shows that when the intermediate temperature sulfiding stage was operated at a temperature of 450° F. the conversion of oxygen to sulfur in the molydbenum compound increased from about 33 percent up to a total of about 81 percent. It is important to note that the catalyst effluent from the intermediate temperature sulfiding stage would not be sufficiently active to inhibit coking reactions associated with high temperature hydroprocessing of heavy residuals. Furthermore, at hydroprocessing temperatures the catalyst will tend to gain oxygen rather than sulfur in the presence of the water in the system, so that it is not possible to complete the sulfiding of the catalyst. Therefore, the precursor catalyst must be further sulfided in a high temperature sulfiding stage, which is operated at a temperature below normal hydroprocessing temperatures.

FIG. 1 shows that when the high temperature sulfiding stage is operated at a temperature of 680° F. the conversion level of oxygen to sulfur in the catalyst is increased from about 81 percent to about 98 percent. At this level of conversion of oxygen to sulfur, the catalyst is sufficiently active to inhibit coking reactions and is not susceptible to acquiring oxygen from water during reaction. It is an active hydroprocessing catalyst and is ready for passage to a hydroprocessing zone.

FIG. 1 indicates the passage of the catalyst from the high temperature sulfiding zone to a hydroprocessing zone operated at a temperature of 810° F. As shown in FIG. 1, the oxygen in the catalyst is essentially 100 percent converted at a temperature of 810° F.

Figure 2:
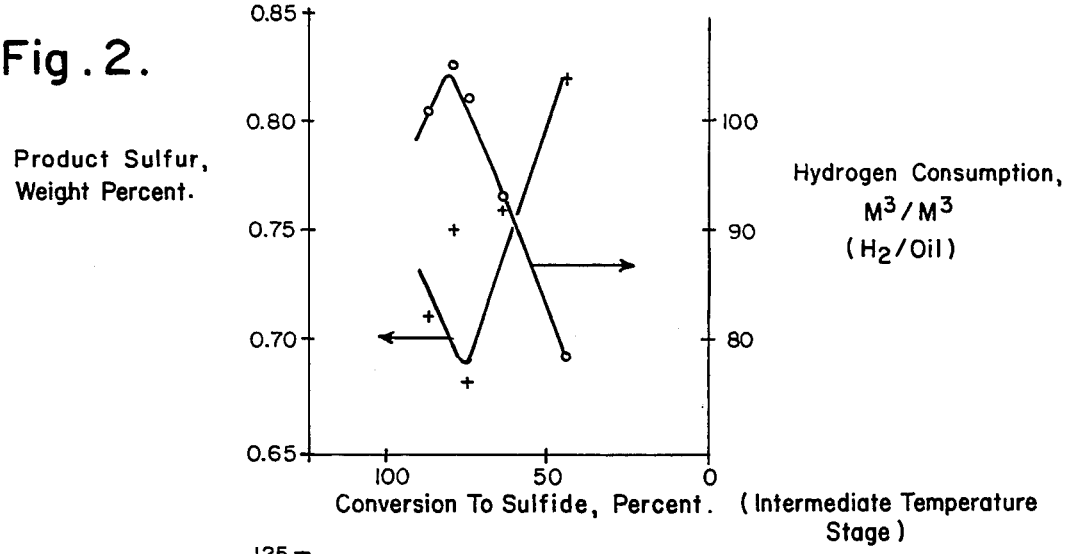
FIG. 2 illustrates the desulfurization and hydrogenation activities, respectively, of a finished slurry catalyst of this invention in terms of the level of conversion of oxygen to sulfur in the molybdenum catalyst achieved in the effluent from the intermediate temperature sulfiding stage.
Figure 3:
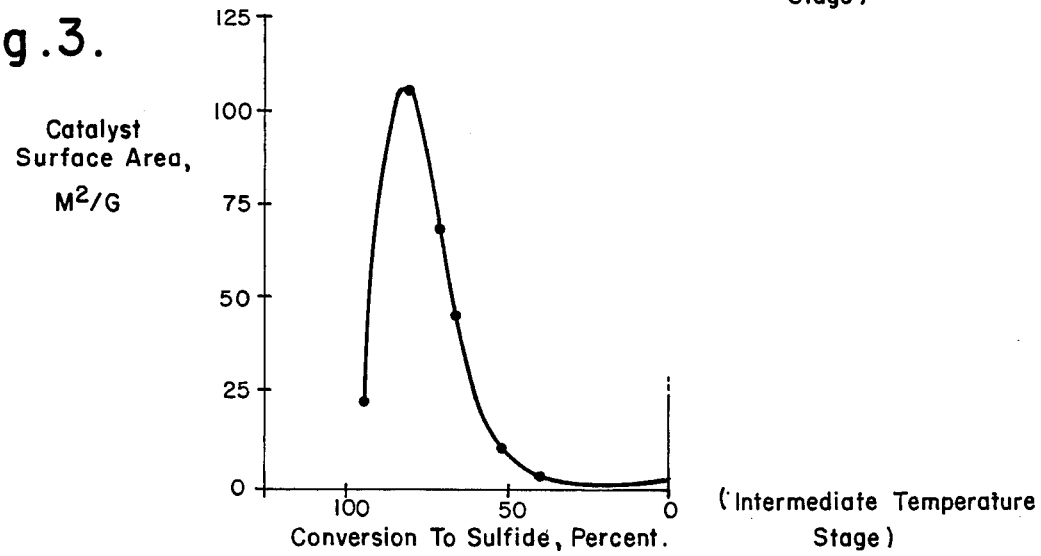
FIG. 3 illustrates the surface area of a finished slurry catalyst of this invention in terms of the level of conversion of oxygen to sulfur.

FIGS. 2 and 3 present data showing the criticality to this invention of completing the sulfiding of the slurry from the low temperature sulfiding stage in two separate subsequent stages of increasing temperature, as contrasted to a single subsequent sulfiding stage operated at a temperature higher than that in the low temperature stage.

FIG. 2 shows that the intermediate temperature stage is a critical activity inducing stage in the sulfiding of an ammonium molybdate catalyst precursor. FIG. 2 presents two catalyst activity curves. One of the curves relates the highest level of conversion of oxygen to sulfur in the molybdenum catalyst precursor occurring in the intermediate temperature stage to the desulfurization activity of the final catalyst. This curve relates the weight percent of sulfur in the light oil product, C5-650° F., to the level of catalyst sulfiding in the intermediate temperature reactor. The other curve of FIG. 2 relates the highest level of conversion of oxygen to sulfur in the catalyst that occurs in the intermediate temperature stage to hydrogen consumption in cubic meters of hydrogen at standard temperature and pressure per cubic meter of oil in a downstream light oil hydroprocess.

FIG. 2 shows that optimum catalyst activity is achieved when the highest or maximum level of conversion of oxygen to sulfur in the precursor catalyst in the intermediate temperature reactor is about 50 to 95 percent, preferably 70 to 85 percent, and most preferably 75 to 80 percent. FIG. 2 clearly shows that the maximum level of conversion of oxygen to sulfur achieved in the precursor catalyst in the intermediate temperature reactor is highly critical to the hydrogenation and desulfurization activity of the final catalyst.

FIG. 3 relates the highest level of conversion of oxygen to sulfur in the precursor catalyst achieved in the intermediate temperature reactor to its surface area in square meters per gram of catalyst. As shown in FIG. 3, when a maximum level of conversion of oxygen to sulfur in the precursor catalyst of about 80 or 85 percent is achieved in the intermediate temperature reactor, the surface area of the precursor peaks as compared to levels of conversion above or below 80 or 85 percent. FIG. 3 shows some surface area elevation occurs over a level of conversion range of 50 to 95 percent.

As was explained above, because the catalyst from the intermediate temperature reactor is incompletely sulfided it would produce an excessive amount of coke if it were passed directly to an oil hydroprocessing reactor. The reason is that usual hydroprocessing temperatures are so high that the catalyst in the presence of water will tend to gain oxygen rather than sulfur. Therefore, it is necessary to pass the slurry catalyst from the intermediate temperature sulfiding stage to a high temperature sulfiding stage which is operated at a temperature lower than the temperature in the subsequent oil hydroprocessing reactor. In the high temperature sulfiding stage, the sulfiding of the catalyst is completed to a level such that in the subsequent oil hydroprocessing reactor it will not gain a significant amount of oxygen and may possibly gain additional sulfur if it is not yet completely sulfided.

Figure 4:
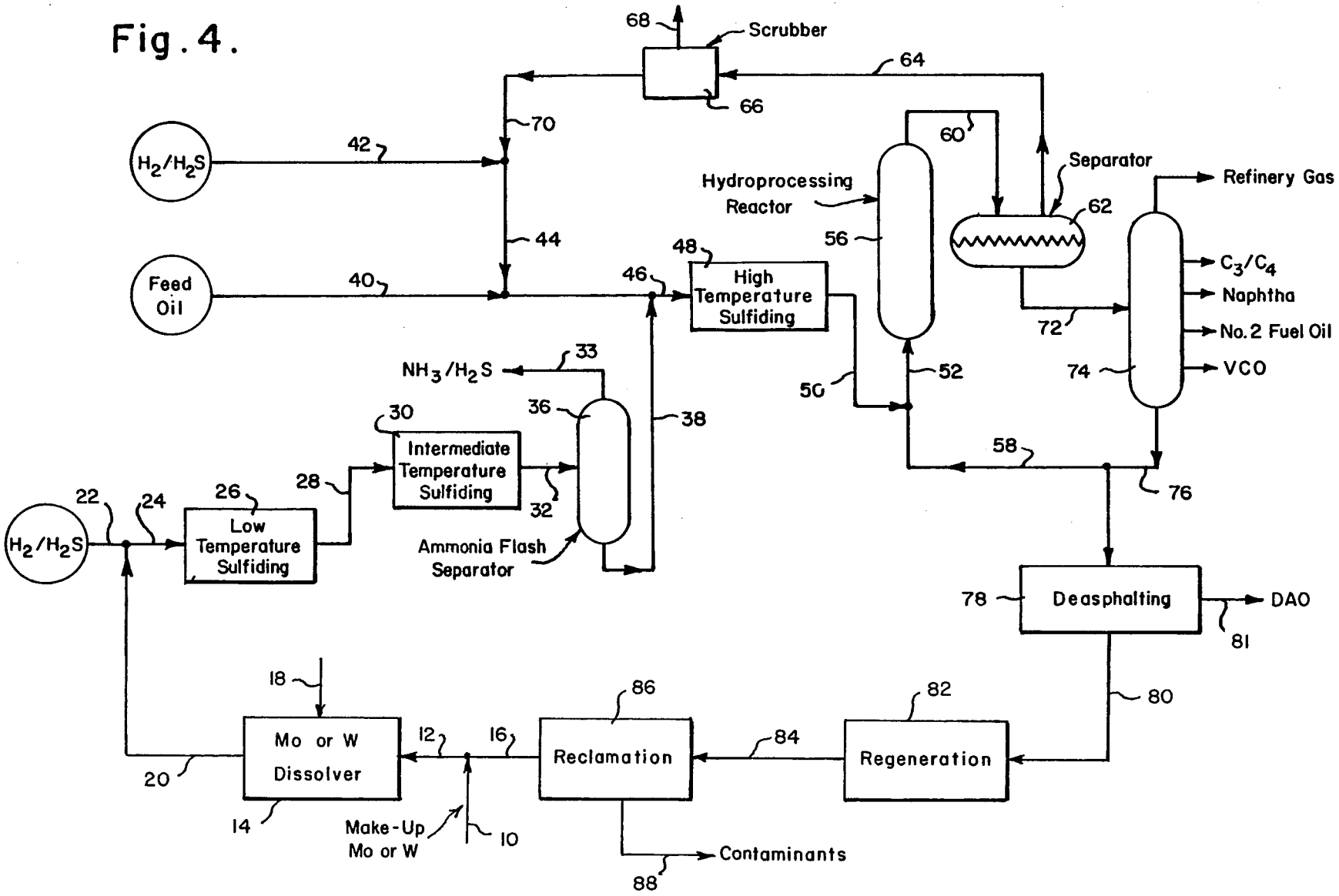
FIG. 4 illustrates an a catalyst preparation method and combination process using the catalyst for the hydroprocessing of hydrocarbon oil.

FIG. 4 illustrates a process for performing the present invention. As shown in FIG. 4, catalytic molybdenum or tungsten, in the form of water-insoluble $MoO_3$ or $WO_3$, is introduced through lines 10 and 12 to dissolver zone 14. Recycle molybdenum or tungsten, from a source described below, is introduced through line 16. Water and ammonia are added to dissolver zone 14 through line 18. Water insoluble molybdenum oxide or tungsten oxide is converted to a water soluble ammonium molybdate salt or ammonium tungstate salt in dissolver zone 14.

Aqueous ammonium molybdate or ammonium tungstate containing excess ammonia is discharged from zone 14 through line 20, admixed with a hydrogen/hydrogen sulfide mixture entering through line 22 and then passed through line 24 to low temperature sulfiding zone 26. In low temperature sulfiding zone 26, ammonium molybdate or ammonium tungstate is convered to thiosubstituted ammonium molybdates or thiosubstituted ammonium tungstates. In zone 26 the sulfiding temperature is sufficiently low that the ammonium salt is not decomposed while thiosubstitution is beginning. If the ammonium salt were decomposed in the early stages of thiosubstitution, an insoluble oxythiomolybdate or a mixture of $MoO_3/MoS_3$, or an insoluble oxythiotungstate or a mixture of $WO_3$ and $WS_3$ would precipitate out in zone 26 and possibly plug zone 26.

An effluent stream from low temperature sulfiding zone 26 is passed through line 28 to intermediate temperature sulfiding zone 30. Intermediate temperature sulfiding zone 30 is operated at a temperature higher than the temperature in low temperature sulfiding zone 26. The sulfiding reaction is continued in zone 30 and ammonium oxythiomolybdate or ammonium oxythiotungstate is converted to molybdenum oxysulfide or tungsten oxysulfide, thereby freeing ammonia. In the effluent from the intermediate temperature sulfiding zone, between 50 and 95 percent, stoichiometrically, of the oxygen in the original soluble ammonium molybdate salt for ammonium tungstate salt is converted to sulfur.

An effluent stream from intermediate temperature sulfiding zone 30 is passed through line 32 to ammonia separator or flash chamber 36. In flash separator 36, cooling and depressurizing of the effluent stream from line 32 causes vaporization of ammonia and hydrogen sulfide. Flash conditions are established so that only a minor amount of water is vaporized and sufficient water remains in the flash residue to maintain an easily pumpable slurry suspension of the catalyst.

Flash separator residue is removed from flash separator 36 through line 38. The flash residue in line 38 is essentially free of oil since no oil was introduced to low temperature sulfiding zone 26 or intermediate temperature sulfiding zone 30. Feed oil is introduced to the system for the first time through line 40 and is admixed with a hydrogen-hydrogen sulfide mixture entering through lines 42 and 44. The flash residue in line 38 together with feed oil, hydrogen and hydrogen sulfide is introduced through line 46 to high temperature sulfiding zone 48.

High temperature sulfiding zone 48 is operated at a temperature higher than the temperature in intermediate temperature sulfiding zone 30. In high temperature sulfiding zone 48, molybdenum oxysulfide or tungsten oxysulfide is converted to highly active molybdenum disulfide or tungsten disulfide. The preparation of the catalyst is now complete. Some hydroprocessing of the feed oil entering through line 40 is performed in high temperature sulfiding zone 48.

An effluent stream from high temperature sulfiding zone 48 is passed through lines 50 and 52 to hydroprocessing reactor 56. Hydroprocessing reactor 56 is operated at a temperature higher than the temperature in high temperature sulfiding zone 48. If the slurry catalyst bypassed high temperature reactor 48 enroute to hydroprocessing reactor 56, the high temperature of hydroprocessing reactor 56 would cause the water in hydroprocessing reactor 56 to oxygenate the catalyst and therefore compete with sulfiding thereby causing the catalyst to become inactive and unable to inhibit coking reactions. When high temperature sulfiding zone 48 precedes the hydroprocessing reactor, the relatively lower temperature in zone 48 allows the sulfiding reaction to prevail over any competing oxidation reaction in the presence of water to complete the sulfiding of the catalyst and render it stable at the higher temperature of hydroprocessing zone 56. With certain oil feedstocks, the relatively lower temperature of high temperature sulfiding zone 48 will suffice for performing the oil hydroprocessing reactions, in which case hydroprocessing reactor 56 can be dispensed with. However, most feed oils will require the relatively higher temperature in hydroprocessing reactor 56 to complete the oil hydrotreating reactions.

An effluent stream is removed from hydroprocessing reactor 56 through line 60 and passed to flash separator 62. An overhead gaseous stream is removed from separator 62 through line 64 and is passed through a scrubber 66 wherein impurities such as ammonia and light hydrocarbons are removed and discharged from the system through line 68. A stream of purified hydrogen and hydrogen sulfide is recycled through lines 70, 44 and 46 to high temperature sulfiding reactor 48.

A bottoms oil is removed from separator 62 through line 72 and passed to atmospheric distillation tower 74. Various fractions are separated in tower 74 including a refinery gas stream, a $C_3/C_4$ light hydrocarbon stream, a naphtha stream, a No. 2 fuel oil and a vacuum charge oil stream for passage to a vacuum distillation tower, not shown.

A concentrated catalyst slurry stream is removed from the bottom of tower 74 through line 76. Some of this catalyst-containing stream can be recycled to hydroprocessing reactor 56 through line 58, if desired. Most, or all, of the heavy catalytic slurry in line 76 is passed to deasphalting chamber 78 from which a deasphalted oil is removed through line 81. A highly concentrated deactivated catalyst stream is removed from deasphalting chamber 78 through line 80 and passed to catalyst regeneration zone 82.

The catalyst entering regeneration zone 82 comprises molybdenum sulfide or tungsten sulfide together with impurity metals acquired from the feed oil. The impurity metals comprise primarily vanadium sulfide and nickel sulfide. In regeneration chamber 82 all of these metal sulfides are oxidized by combustion to the oxide state. The metal oxides are then passed through line 84 to catalyst reclamation zone 86. In reclamation zone 86 molybdenum oxide or tungsten oxide is separated from impurity metals including vanadium oxide and nickel oxide by any suitable means. Non-dissolved impurity metals including vanadium and nickel are discharged from the system through line 88 while purified and concentrated molybdenum oxide or tungsten oxide is passed through line 16 for mixing with make-up molybdenum or tungsten oxide entering through line 10, to repeat the cycle.

If desired, the process shown in FIG. 4 can be modified by inserting ammonia flash separator 36 in advance of intermediate temperature sulfiding reactor 30. In that case, the hydrogen and hydrogen sulfide mixture in line 42 and the feed oil in line 40 can be charged to intermediate temperature sulfiding reactor 30. The effluent from intermediate temperature sulfiding reactor 30 would be passed directly to high temperature sulfiding reactor 48, without any intermediate separation.

We claim:

1. A process including the preparation of a dispersed Group VIB metal sulfide hydrocarbon oil hydroprocessing catalyst comprising sulfiding an aqueous ammonium salt of oxygen-containing Group VIB metal compound in at least three sulfiding steps of increasing temperature including a low temperature sulfiding step having a temperature in the range 70° to 350° F., an intermediate temperature sulfiding step having a temperature in the range 180° to 700° F. which is higher than the temperature in said low temperature sulfiding step, and a feed hydrocarbon oil-containing high temperature sulfiding step having a temperature in the range 500° to 750° F. which is higher than the temperature in said intermediate temperature step, the residence time in each of said sulfiding steps being at least 0.02 hours, some of the oxygen associated with said Group VIB metal being replaced by sulfur in each of said sulfiding steps, in said intermediate temperature sulfiding step the total stoichiometric replacement with sulfur of oxygen associated with said Group VIB metal achieving a maximum level of 50 to 95 percent, with additional replacement of oxygen with sulfur occurring in said high temperature step.

2. The process of claim 1 wherein hydrogen sulfide is used to sulfide said catalyst.

3. The process of claim 1 wherein feed hydrocarbon oil is present in said low and intermediate temperature sulfiding steps.

4. The process of claim 1 wherein feed hydrocarbon oil is present in said intermediate temperature sulfiding step.

5. The process of claim 1 wherein said Group VIB metal is molybdenum.

6. The process of claim 1 wherein said Group VIB metal is tungsten.

7. The process of claim 1 wherein in said intermediate temperature sulfiding step the total stoichiometric replacement with sulfur of oxygen associated with said Group VIB metal achieving a maximum level of 70 to 85 percent.

8. The process of claim 1 wherein in said intermediate temperature sulfiding step the total stoichiometric replacement with sulfur of oxygen associated with said Group VIB metal achieving a maximum level of 75 to 80 percent.

9. The process of claim 1 wherein said low temperature sulfiding step is operated at a temperature in the range 130° to 180° F.

10. The process of claim 1 wherein said intermediate temperature sulfiding step is operated at a temperature in the range 300° to 550° F.

11. The process of claim 1 wherein said residence time is at least 0.1 hours.

12. A process including the preparation of a dispersed Group VIB metal sulfide hydrocarbon oil hydroprocessing catalyst comprising sulfiding in low, intermediate and high temperature sulfiding steps an aqueous ammonium oxygen-containing Group VIB metal compound to replace oxygen associated with said Group VIB metal with sulfur, replacing some of the oxygen associated with said Group VIB metal with sulfur in said low temperature sulfiding step at a temperature between 70° and 350° F., continuing the replacement of oxygen associated with said Group VIB metal with sulfur in said intermediate temperature sulfiding step at a temperature between 180° and 700° F., said intermediate temperature sulfiding step operating at a temperature which is higher than the temperature in said low temperature sulfiding step, in said intermediate temperature sulfiding step the total stoichiometric replacement of oxygen with sulfur achieving a maximum level of 50 to 95 percent, continuing the replacement of oxygen with sulfur in the presence of feed oil in said high temperature step reactor at a temperature between 500° and 750° F., said high temperature sulfiding step operating at a temperature which is higher than the temperature in said intermediate temperature sulfiding step, the residence time in each of said sulfiding steps being at least 0.02 hours, and withdrawing from said high temperature sulfiding step an aqueous-oil slurry containing dispersed Group VIB metal sulfide slurry catalyst.

13. The process of claim 12 including withdrawing an aqueous effluent stream from at least one step selected from said low and said intermediate temperature sulfiding steps, passing said effluent stream to a separator zone, removing ammonia from said aqueous effluent stream in said separator zone leaving a separator residue, and passing said separator residue together with feed oil to the next higher temperature sulfiding step.

14. The process of claim 12 wherein feed oil is present in the low temperature sulfiding step and the intermediate temperature sulfiding step.

15. The process of claim 12 wherein said sulfiding is performed with hydrogen sulfide.

16. The process of claim 14 wherein said Group VIB metal is molybdenum.

17. The process of claim 12 wherein said low temperature sulfiding step is operated at a temperature in the range 130° to 180° F.

18. The process of claim 12 wherein said intermediate temperature sulfiding step is operated at a temperature in the range 300° to 550° F.

19. The process of claim 12 wherein said residence time is at least 0.1 hours.

20. The process of claim 12 wherein said low and intermediate temperature sulfiding steps are performed with a gas containing a hydrogen/hydrogen sulfide blend.

21. The process of claim 12 wherein said Group VIB metal is tungsten.

22. The process of claim 12 wherein said feed oil is refractory heavy distillate.

23. The process of claim 12 wherein said feed oil is heavy crude oil.

24. The process of claim 12 wherein said feed oil is a residual oil.

25. A process including the preparation of a dispersed Group VIB metal sulfide hydrocarbon oil hydroprocessing catalyst comprising reacting ammonia and a Group VIB metal compound in water to form an aqueous ammonium oxygen-containing Group VIB metal compound, reacting said aqueous ammonium Group VIB metal compound in the presence hydrogen, hydrogen sulfide and feed oil in a low temperature sulfiding step at a temperature between 70° and 350° F. to replace oxygen associated with said Group VIB metal with sulfur, continuing the replacement of oxygen associated with said Group VIB metal with sulfur in the presence of hydrogen, hydrogen sulfide and feed oil in an intermediate temperature sulfiding step at a temperature between 180° and 750° F., said intermediate temperature sulfiding step operated at a temperature which is higher than the temperature in said low temperature sulfiding step, in said intermediate temperature sulfiding step the total stoichiometric replacement of oxygen associated with said Group VIB metal with sulfur achieving a maximum level of 50 to 95 percent, continuing the replacement of oxygen associated with the Group VIB metal with sulfur in the presence of hydrogen, hydrogen sulfide and feed oil in a high temperature sulfiding step at a temperature between 500° and 750° F. to replace additional oxygen associated with said Group VIB metal with sulfur, said high temperature sulfiding step operated at a temperature which is higher than the temperature in said intermediate temperature sulfiding step, the residence time in each of said sulfiding steps being at least 0.02 hours, and withdrawing from said high temperature sulfiding step an aqueous-oil slurry containing dispersed Group VIB metal sulfide slurry catalyst.

26. The process of claim 25 wherein said Group VIB metal is molybdenum.

27. The process of claim 25 wherein said Group VIB metal is tungsten.

28. The process of claim 25 wherein the total stoichiometric replacement of oxygen associated with said Group VIB metal with sulfur achieving a maximum level of 70 to 85 percent in said intermediate temperature step.

29. The process of claim 25 wherein the total stoichiometric replacement of oxygen associated with said Group VIB metal with sulfur achieving a maximum level of 75 to 80 percent in said intermediate temperature step.

30. The process of claim 25 wherein the temperature in said low temperature sulfiding step is 130° to 180° F.

31. The process of claim 25 wherein the temperature in said intermediate temperature sulfiding step is 300° to 550° F.

32. The process of claim 25 wherein said residence time is at least 0.1 hours.

33. The process of claim 1 wherein said residence time is at least 0.2 hours.

34. The process of claim 1 wherein said residence time is at least 0.3 hours.

35. The process of claim 1 wherein said residence time is at least 0.4 hours.

36. The process of claim 1 wherein said residence time is at least 0.5 hours.

* * * * *

UNITED STATES PATENT AND TRADEMARK OFFICE

CERTIFICATE OF CORRECTION

PATENT NO. : 4,710,486

DATED December 1, 1987

INVENTOR(S) : JAIME LOPEZ ET AL.

It is certified that error appears in the above-identified patent and that said Letters Patent are hereby corrected as shown below:

Title page:

ATTORNEY, AGENT, OR FIRM - "S. R. LaPaglia; T. G. DeJonghe; O. T. Dickinson" should read --S. R. LaPaglia; T. G. DeJonghe; Q. T. Dickinson--

Col. 13, line 64, "Claim 14" should read --Claim 12--

Signed and Sealed this

Third Day of May, 1988

*Attest:*

*Attesting Officer*

DONALD J. QUIGG

*Commissioner of Patents and Trademarks*